US011052298B2

(12) United States Patent
Riffey

(10) Patent No.: US 11,052,298 B2
(45) Date of Patent: Jul. 6, 2021

(54) GOLF BALL POSITION GAUGING ASSEMBLY AND METHOD

(71) Applicant: Dave Riffey, Sioux Falls, SD (US)

(72) Inventor: Dave Riffey, Sioux Falls, SD (US)

( * ) Notice: Subject to any disclaimer, the term of this patent is extended or adjusted under 35 U.S.C. 154(b) by 38 days.

(21) Appl. No.: 15/900,974

(22) Filed: Feb. 21, 2018

(65) Prior Publication Data

US 2019/0255414 A1 Aug. 22, 2019

(51) Int. Cl.
*A63B 69/36* (2006.01)

(52) U.S. Cl.
CPC ..... *A63B 69/3667* (2013.01)

(58) Field of Classification Search
CPC ..... A63B 57/06
USPC ..... 473/157, 162, 266, 270, 273
See application file for complete search history.

(56) References Cited

U.S. PATENT DOCUMENTS 2,303,736 A * 12/1942 Hall ..... A63B 69/3676 473/258
4,257,608 A * 3/1981 Funk ..... A63B 69/3667 473/272
4,322,084 A 3/1982 Reece et al.
5,246,234 A 9/1993 Zambelli
5,255,921 A * 10/1993 Spence ..... A63B 69/3667 434/252
5,362,060 A 11/1994 Hinson
5,730,659 A 3/1998 Morita
5,776,007 A * 7/1998 Kendall ..... A63B 69/3676 248/176.1
5,944,613 A 8/1999 Dubois
6,129,639 A * 10/2000 Brock ..... A63B 69/3676 473/260
6,443,852 B1 * 9/2002 Kim ..... A63B 69/3676 473/257
6,723,003 B1 * 4/2004 Harrell ..... A63B 69/3667 473/266
6,726,576 B1 * 4/2004 Froggatte ..... A63B 69/3608 473/270
6,752,724 B1 6/2004 Schumacher
7,037,210 B2 * 5/2006 Bainter ..... A63B 69/3667 473/270
7,431,661 B1 * 10/2008 Cailey ..... A63B 60/22 473/257
7,607,987 B2 10/2009 Alter
8,696,484 B2 * 4/2014 Shahi ..... A63B 69/3667 473/257
8,834,287 B1 9/2014 Reid
9,126,092 B2 9/2015 Deacon
9,259,635 B2 2/2016 Downing
(Continued)

*Primary Examiner* — Raeann Gorden

(57) ABSTRACT

A golf ball position gauging assembly allows for a method of improving results based on a user's existing swing without modifying the existing swing. The assembly includes a pair of feet. Each foot has an associated aperture extending therethrough. Each of the feet has a bottom edge downwardly spaced from the associated aperture. A beam is insertable into or through each of the apertures such that the beam extends between the feet in an upwardly spaced position relative to the bottom edges of the feet. Each of a plurality of markings is incrementally spaced along the beam between the feet. The beam is insertable through a guide wherein the guide is slidable along the beam to be positioned adjacent to a selectable one of the markings.

7 Claims, 6 Drawing Sheets

(56) References Cited

U.S. PATENT DOCUMENTS 9,550,104 B2 1/2017 Taft
9,861,873 B1 * 1/2018 Davis ..... A63B 69/3644

* cited by examiner

GOLF BALL POSITION GAUGING ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to golf ball positioning devices and more particularly pertains to a new golf ball positioning device for consistently positioning a golf ball in differing positions during practice to find a repeatable optimum position based on a user's existing swing.

BRIEF SUMMARY OF THE INVENTION

An embodiment of the disclosure meets the needs presented above by generally comprising a pair of feet. Each foot has an associated aperture extending therethrough. Each of the feet has a bottom edge downwardly spaced from the associated aperture. A beam is insertable into or through each of the apertures such that the beam extends between the feet in an upwardly spaced position relative to the bottom edges of the feet. Each of a plurality of markings is incrementally spaced along the beam between the feet. The beam is insertable through a guide wherein the guide is slidable along the beam to be positioned adjacent to a selectable one of the markings. The assembly provides for a method of improving golf swing results without modifying an existing swing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
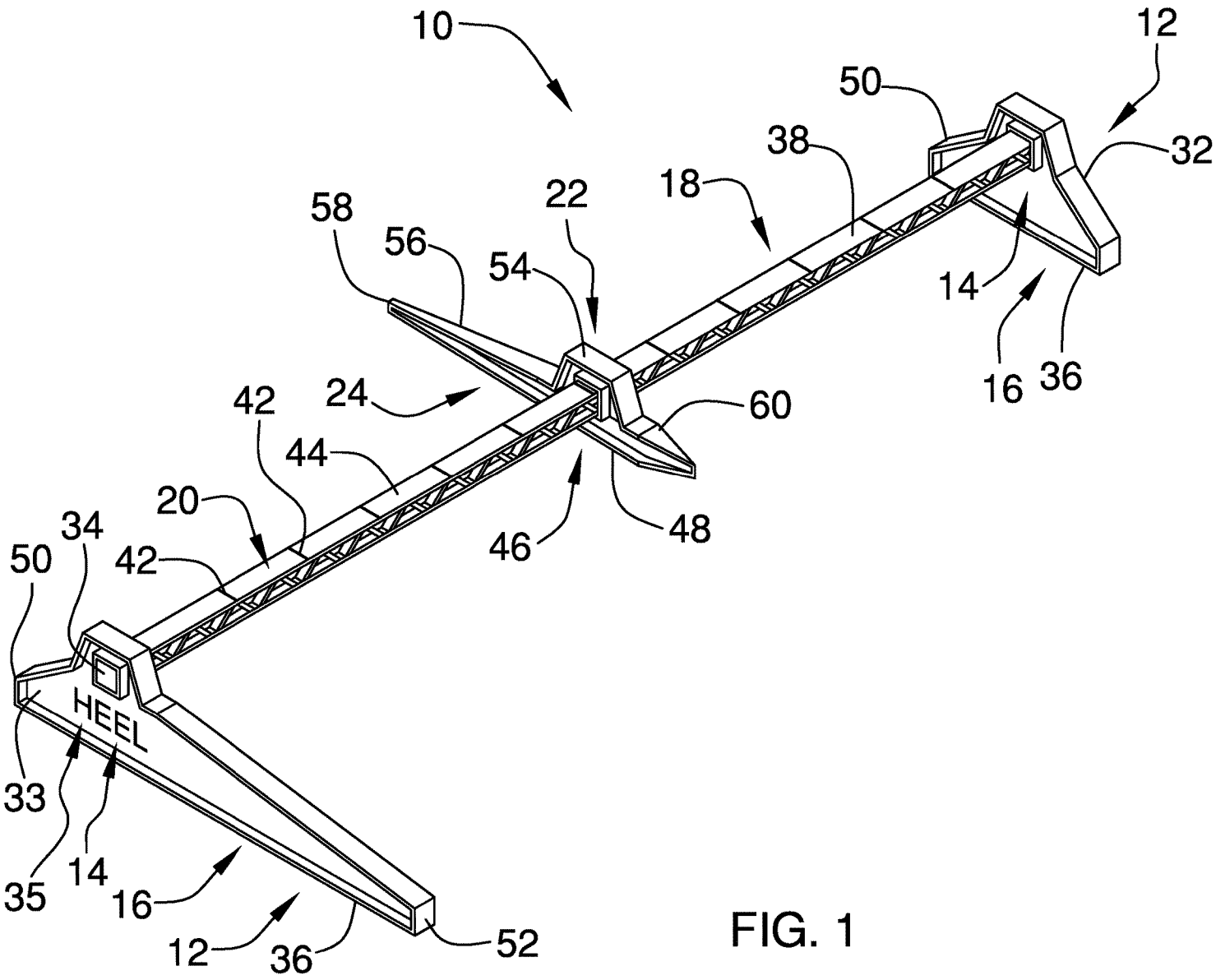
FIG. 1 is a top front side perspective view of a golf ball position gauging assembly and method according to an embodiment of the disclosure.
Figure 2:
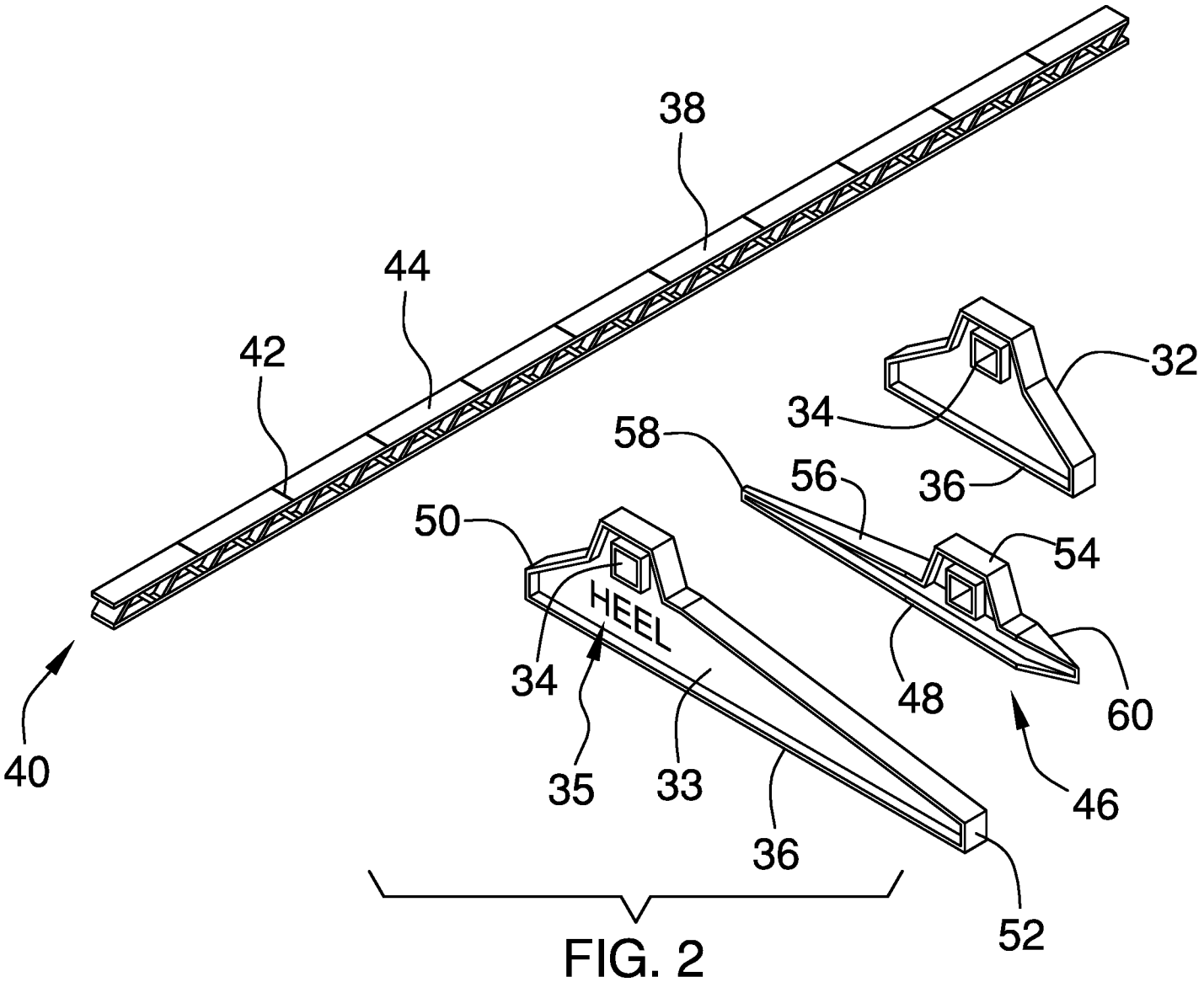
FIG. 2 is a top front side perspective view of an embodiment of the disclosure disassembled.
Figure 3:
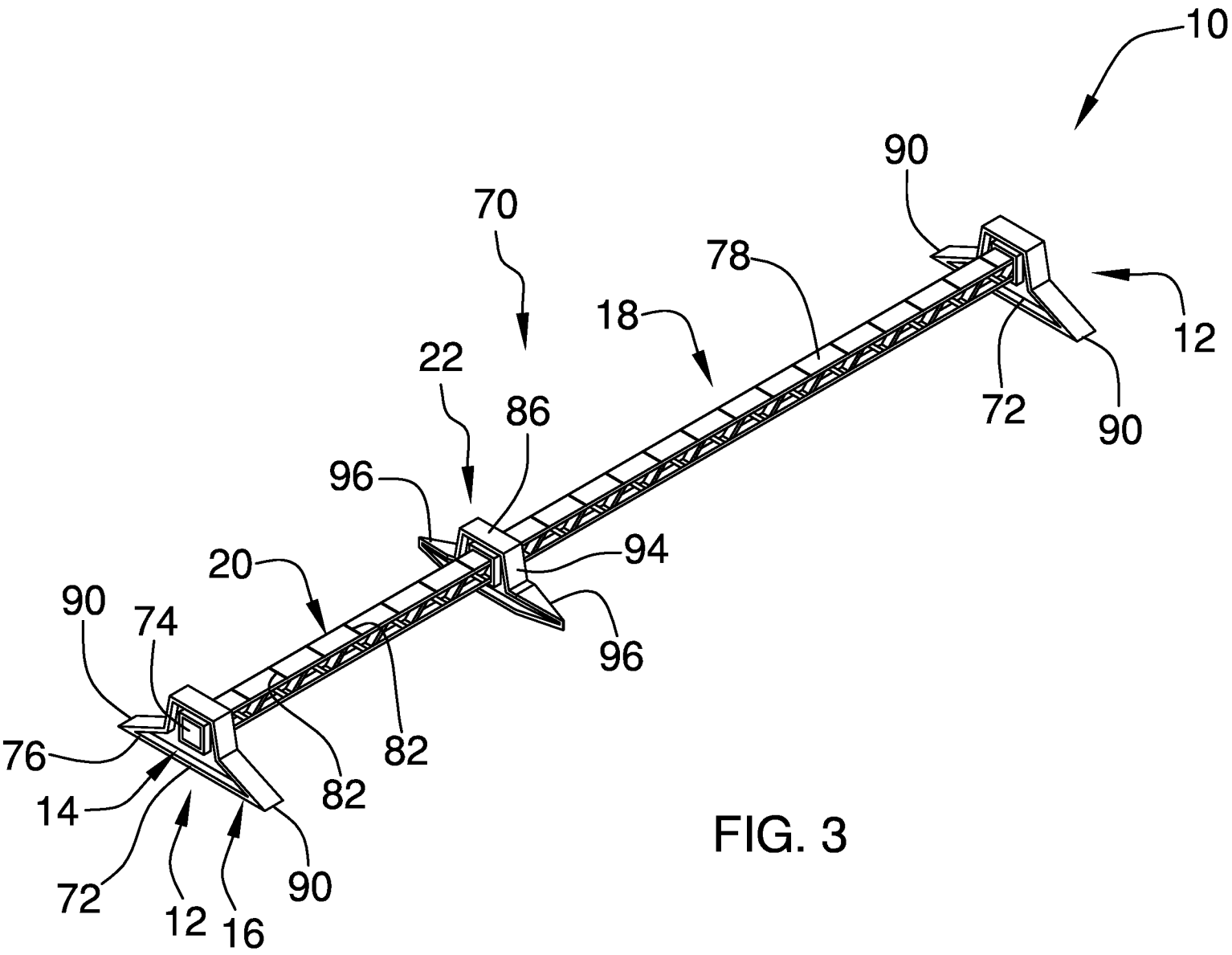
FIG. 3 is a top front side perspective view of an embodiment of the disclosure.
Figure 4:
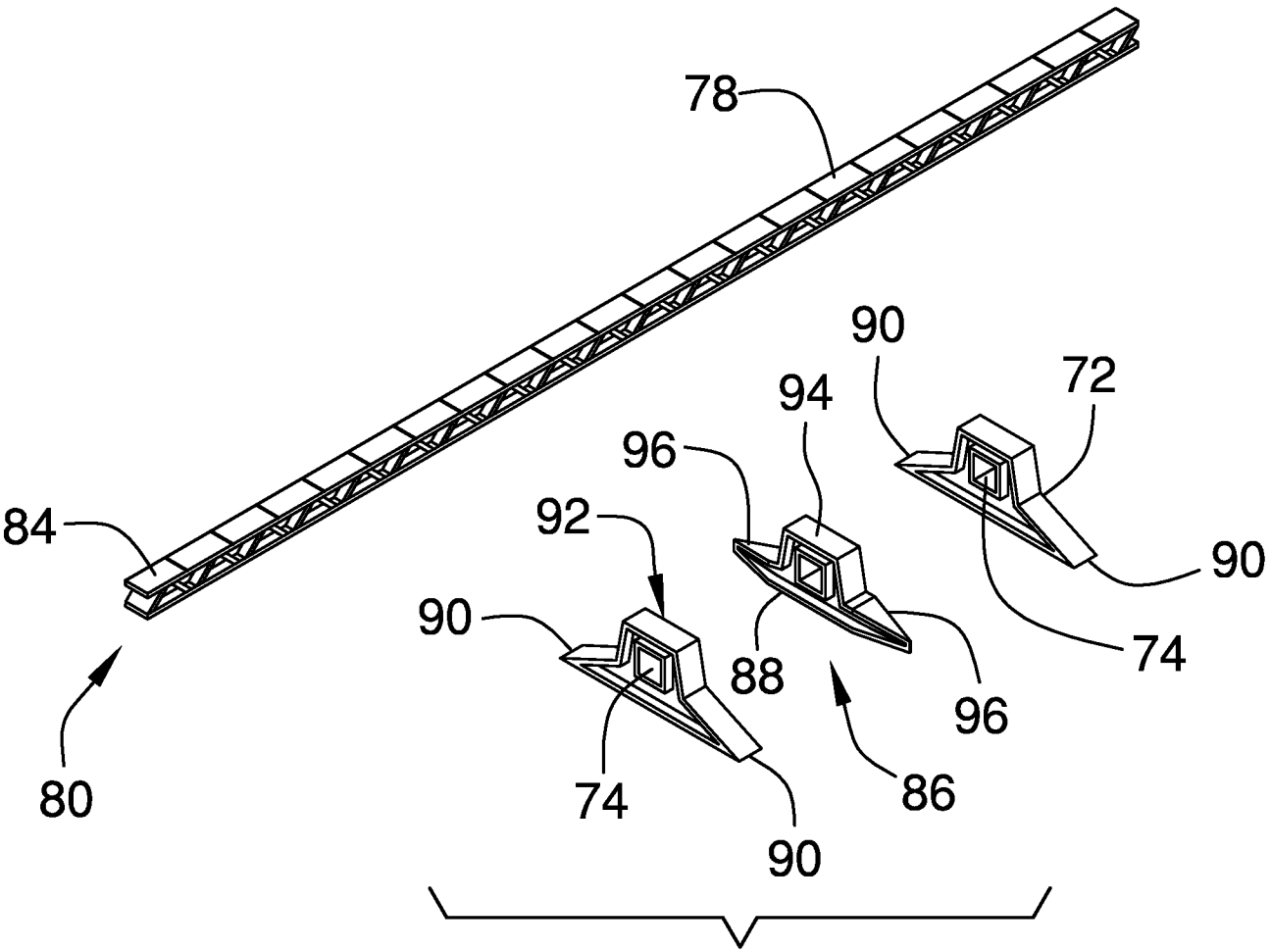
FIG. 4 is a top front side perspective view of an embodiment of the disclosure disassembled.
Figure 5:
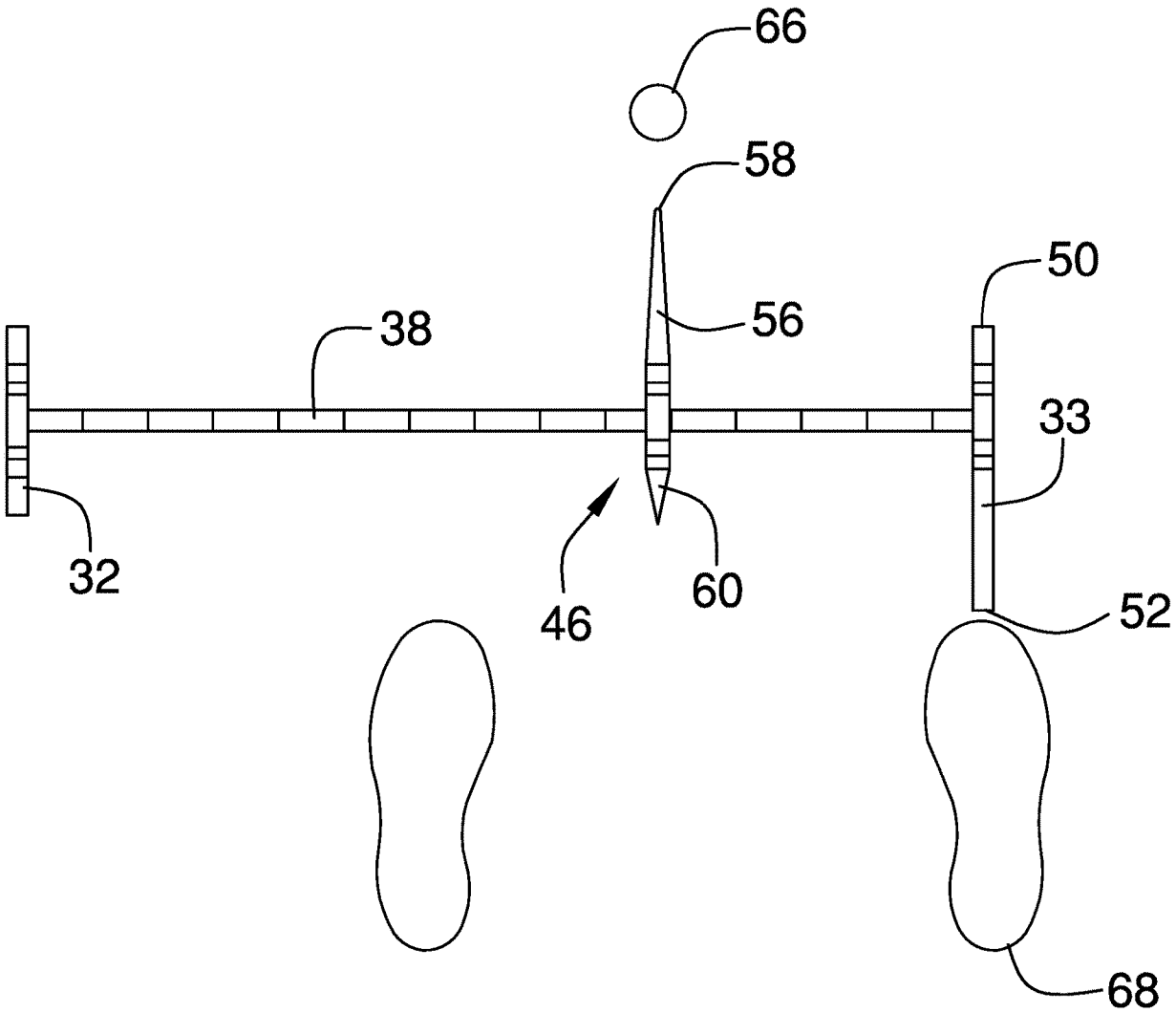
FIG. 5 is a front view of an embodiment of the disclosure in use.
Figure 6:
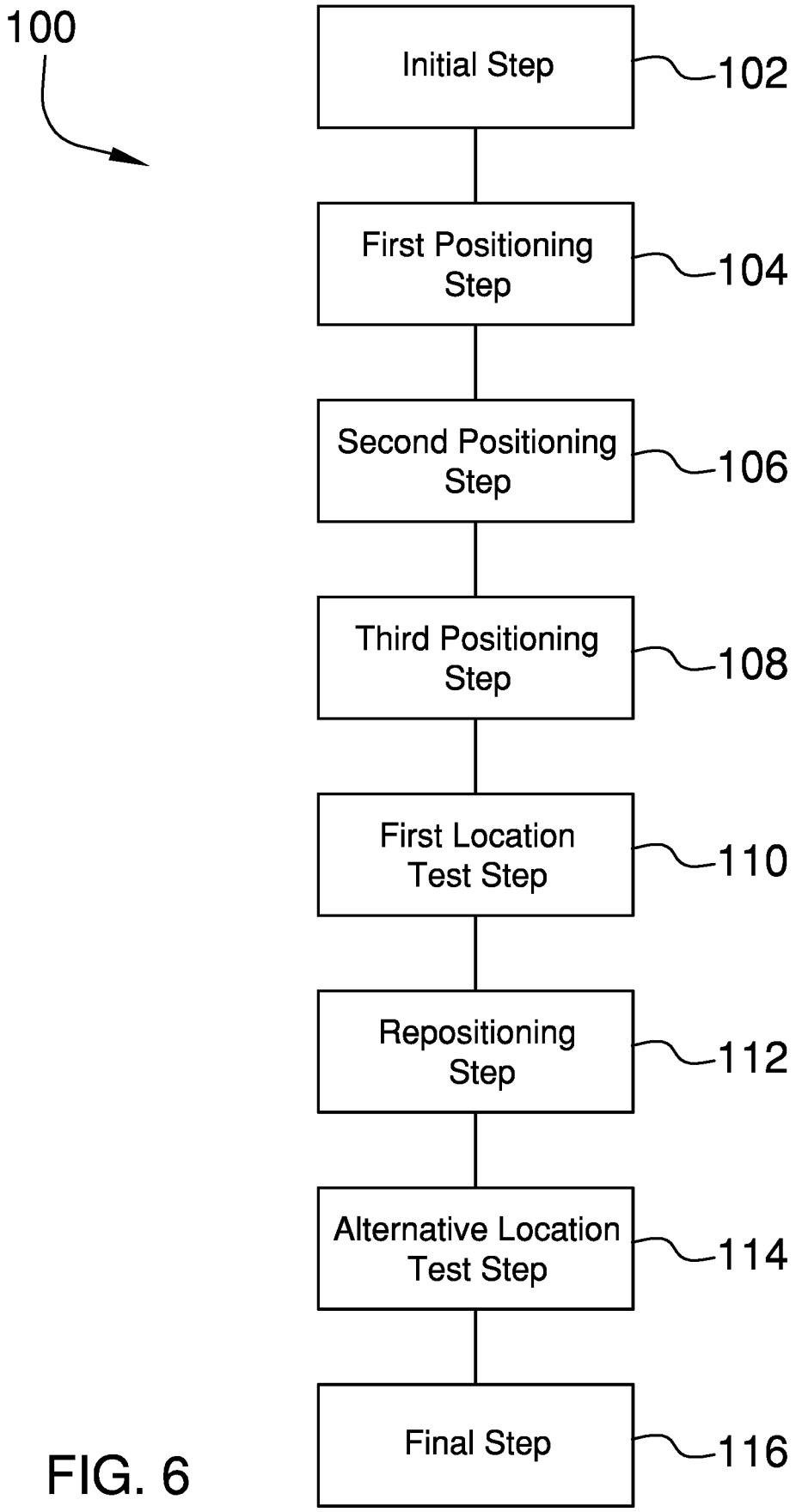
FIG. 6 is a schematic view of an embodiment of the disclosure.

With reference now to the drawings, and in particular to FIGS. 1 through 6 thereof, a new golf ball positioning device embodying the principles and concepts of an embodiment of the disclosure and generally designated by the reference numeral 10 will be described.

As best illustrated in FIGS. 1 through 6, the golf ball position gauging assembly 10 generally comprises a pair of feet 12. Each foot 12 has an associated aperture 14 extending therethrough. Each of the feet 12 has a straight bottom edge 16 downwardly spaced from the associated aperture 14. A beam 18 is insertable into each of the apertures 14 whereby the beam 18 is coupled to and extends between the feet 12 in an upwardly spaced position relative to the bottom edges 16 of the feet 12. Each of a plurality of markings 20 is positioned on the beam 18. The markings 20 are incrementally spaced along the beam 18 between the feet 12. The beam 18 is insertable through a guide 22 wherein the guide 22 is slidable along the beam 18 to be positioned adjacent to a selectable one of the markings 20. The markings 20 may be evenly spaced comprising lines, numbers, letters, symbols or the like, to distinguish and mark distinct positions along the beam 18 which may be recorded to facilitate reproducing specific positioning of the guide 22 on the beam 18. A bottom face 24 of the guide 22 is upwardly spaced from the bottom edges 16 of the feet 12 wherein the guide 22 is configured for being suspended on the beam 18 over a supporting surface 26 upon which the feet 12 rest.

The above description applies generally to embodiments described below setting forth a swinging gauge 30 used for optimizing ball position for irons and woods and a putting gauge 70 used for optimizing ball position for putting.

In the swing gauge 30 the feet 12 include a front swing foot 32 and a rear swing foot 33. Each of the front swing foot 32 and the rear swing foot 33 has an associated swing aperture 34 extending therethrough. Each of the front swing foot 32 and the rear swing foot 33 has a bottom edge 36 downwardly spaced from the associated swing aperture 34. A swing beam 38 is insertable through each of the swing apertures 34 whereby the swing beam 38 is coupled to and extends between the front swing foot 32 and the rear swing foot 33 in upwardly spaced position relative to the bottom edges 36 of the front swing foot 32 and the rear swing foot 33. The swing beam 38 has a square cross-sectional shape 40 perpendicular to a longitudinal axis of the swing beam 38. Each aperture 34 extending through the front swing foot 32 and the rear swing foot 33 is complementary in shape to the cross-sectional shape of the swing beam 38. Each of a plurality of swing markings 42 is positioned on the swing beam 38. The swing markings 42 may be in an upper face 44 of the swing beam 38. The swing markings 42 are incrementally spaced along the swing beam 38 between the front swing foot 32 and the rear swing foot 33. The swing beam 38 is insertable through a swing guide 46 wherein the swing guide 46 is slidable along the swing beam 38 to be positioned adjacent to a selectable one of the swing markings 42. A bottom face 48 of the swing guide 46 is upwardly spaced from the bottom edges 36 of the front swing foot 32 and the rear swing foot 33 wherein the swing guide 46 is configured for being suspended on the swing beam 38 over the supporting surface 26 upon which the front swing foot 32 and the rear swing foot 33 rest. The rear swing foot 33 is elongated between a first end 50 and a second end 52. The associated swing aperture 34 of the rear swing foot 33 is positioned proximate to the first end 50 of the rear swing foot 33.

The swing guide 46 has a medial section 54. The swing beam 38 extends through the medial section 54 when the swing beam 38 is inserted through the swing guide 46. A first pointer 56 is coupled to and extends from the medial section 54 such that the first pointer 56 is perpendicular to the swing beam 38. The first pointer 56 is elongated such that a distal end 58 of the first pointer 56 relative to the swing beam 38 is positioned beyond a line extending from the first end 50 of the rear swing foot 33 parallel to the swing beam 38. A second pointer 60 is diametrically opposed to the first pointer 56 pointing in an opposite direction to the first pointer 56. The second pointer 60 has a length less than a length of the first pointer 56. The front swing foot 32, the rear swing foot 33, swing beam 38, and swing guide 46 may be assembled into different configurations allowing for variable positioning of either the first pointer 56 and the second pointer 60 relative to either the first end 50 and second end 52 of the rear swing foot 33. The relative distance may be shortened for shorter clubs or extended for longer clubs to facilitate visual inspection as to the position of a golf ball 66 relative to a user's rear heel 68 positioned in alignment with either of the front swing foot 32 or the rear swing foot 33. The rear swing foot 33 may also be marked or include integral indicia 35. The indicia 35 may be a word such as "heel" or the like indicating that the rear swing foot 33 is typically positioned adjacent to the rear foot in a conventional golf swing stance.

The putting gauge 70 is generally similar to the swing gauge 30 and is presumed to have similar structure except as noted below. Each of a pair of putter feet 72 has an associated putter aperture 74 extending therethrough. Each of the putter feet 72 has a bottom edge 76 downwardly spaced from the associated putter aperture 74. A putter beam 48 is insertable into and/or through each of the putter apertures 74. Thus, the putter beam 78 is coupled to and extends between the putter feet 72 in upwardly spaced position relative to the bottom edges 76 of the putter feet 72. The putter beam 78 has a square cross-sectional shape 80 perpendicular to a longitudinal axis of the putter beam 78. Each of a plurality of putter markings 82 is positioned on the putter beam 78 on an upper face 84 of the putter beam 78. The putter markings 82 are incrementally spaced along the putter beam 78 between the putter feet 72. As a putting swing is more compact than the full swing used for irons or drivers, the putter beam 78 may be shorter than the swing beam 38 and spacing between the putter markings 82 may be less than between the swing markings 42.

The putter beam 78 is insertable through a putter guide 86 wherein the putter guide 86 is slidable along the putter beam 78 to be positioned adjacent to a selectable one of the putter markings 82. A bottom face 88 of the putter guide is upwardly spaced from the bottom edges 76 of the putter feet 72 wherein the putter guide 86 is configured for being suspended on the putter beam 78 over the supporting surface 26 upon which the putter feet 72 rest. Each associated putter aperture 74 is positioned equidistant between opposite ends 90 of the putter foot 72 wherein the putter beam 78 extends perpendicularly from a middle 92 of each putter foot 72.

The putter guide 86 includes a middle section 94 and a pair of needles 96. The needles 96 extend from diametrically opposed sides 98 of the middle section 94 wherein each of the needles 96 is perpendicular to the putter beam 78. The needles 96 are symmetrically positioned with respect to the putter aperture 74 and thus, the putter beam 78 when the putter beam 78 is inserted through the putter guide 86. A length between points of the needles 96 is equal to a length of each of the putter feet 72.

In use, the assembly 10 allows for a method 100 of determining optimum ball position for a golf swing without modifying the golf swing. Current manners of teaching typically seek to change the user's swing to conform to a universal idealized swing. However, infinite variety in physical attributes and equipment combinations and differing structures renders change of the swing to conform to the ideal supremely difficult. In contrast, the assembly 10 provides for the method 100 to optimize results without modifying a user's swing. The method 100 is further repeatable to provide optimization of results relating to a single factor, ball position, while using whatever the user's natural swing may be at a given time. The method 100 is generally comprised of an initial step 102 of having the golf ball position gauging assembly 10 as described generally above. The method 100 may be more particularly applied to full swing or putting using the swing gauge 30 or putting gauge 70 as described above. The method 100 may be used when practicing on a driving range or putting green. A first positioning step 104 is positioning a user's rear heel in alignment with one of the feet 12 such that the beam 18 extends generally towards a user's forward heel or foot with the beam 18 being parallel to a target line. A second positioning step 106 is positioning the guide 22 at a first location along the beam 18 and recording the position using one of the markings 20. A third positioning step 108 is positioning a golf ball in alignment with the guide 22 at the first location. A first location test step 110 is achieved by striking the golf ball with a golf club and observing a path of travel of the golf ball. This first location test step 110 may be repeated several times to determine a reasonable expected result based on the first position. A respositioning step 112 is achieved by repositioning the guide 22 and golf ball corresponding to a second location along the beam 18 before an alternative location test step 114 of striking the golf ball and observing the path of travel of the golf ball for the respositioned location. The alternative location test step may be repeated several times and for additional unique locations along the beam 18. A final step 116 is selecting an optimum ball position corresponding which path of travel observed is nearest to a most desired path of travel for the golf ball. This produces optimized results for a given golf swing and the method 100 may be repeated to facilitate later correction of ball positioning to optimize results should the user's golf swing change over time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf ball position gauging assembly comprising:

a front foot and a rear foot, each of said front foot and said rear foot having an associated aperture extending therethrough, each of said front foot and said rear foot having a bottom edge being downwardly spaced from said associated aperture;

a beam, said beam being insertable through each of said apertures whereby said beam is coupled to and extends between said front foot and said rear foot in upwardly spaced position relative to said bottom edges of said front foot and said rear foot;

a plurality of markings on said beam, said markings being incrementally spaced along said beam between said front foot and said rear foot wherein said beam is configured for consistent placement of a golf ball relative to said markings, said front foot, and said rear foot; and a guide, said beam being insertable through said guide wherein said guide is slidable along said beam to be positioned adjacent to a selectable one of said markings wherein said guide is configured for facilitating positioning of a golf ball consistently to permit testing and recording of results from striking a golf ball from different positions by a user to find an optimal ball position for a user, a bottom face of said guide being upwardly spaced from said bottom edges of said front foot and said rear foot wherein said guide is configured for being suspended on said beam over a supporting surface upon which said front foot and said rear foot rest.

2. The assembly of claim 1, further comprising said beam having a square cross-sectional shape perpendicular to a longitudinal axis of said beam.

3. The assembly of claim 1, further comprising each said associated aperture being positioned equidistant between opposite ends of said front foot and said rear foot wherein said beam extends perpendicularly from a middle of each of said front foot and said rear foot.

4. The assembly of claim 3, wherein said guide further comprises:

a middle section; and a pair of needles, said needles extending from diametrically opposed sides of said middle section wherein each of said needles is perpendicular to said beam.

5. The assembly of claim 4 wherein said needles are symmetrically positioned with respect to said beam when said beam is inserted through said guide.

6. The assembly of claim 4, further comprising a length between points of said needles being equal to a length of each of said front foot and said rear foot.

7. A golf ball position gauging assembly comprising:

a swinging gauge comprising a front swing foot and a rear swing foot, each of said front swing foot and said rear swing foot having an associated swing aperture extending therethrough, each of said front swing foot and said rear swing foot having a respective bottom edge being downwardly spaced from said associated swing aperture, a swing beam, said swing beam being insertable through each of said swing apertures whereby said swing beam is coupled to and extends between said front swing foot and said rear swing foot in upwardly spaced position relative to said bottom edges of said front swing foot and said rear swing foot, said swing beam having a square cross-sectional shape perpendicular to a longitudinal axis of said swing beam, a plurality of swing markings on said swing beam, said swing markings being incrementally spaced along said swing beam between said front swing foot and said rear swing foot wherein said beam is configured for consistent placement of a golf ball relative to said markings, said front foot, and said rear foot, a swing guide, said swing beam being insertable through said swing guide wherein said swing guide is slidable along said swing beam to be positioned adjacent to a selectable one of said swing markings wherein said swing guide is configured for facilitating and recording positioning of a golf ball consistently to permit testing and recording of results from striking a golf ball from different positions to find an optimal ball position, a bottom face of said swing guide being upwardly spaced from said bottom edges of said front swing foot and said rear swing foot wherein said swing guide is configured for being suspended on said swing beam over a supporting surface upon which said front swing foot and said rear swing foot rest, said rear swing foot being elongated between a first end and a second end, said associated swing aperture of said rear swing foot being positioned proximate to said first end of said rear swing foot, and wherein said swing guide further comprises a medial section, said swing beam extending through said medial section when said swing beam is inserted through said swing guide, a first pointer coupled to and extending from said medial section such that said pointer is perpendicular to said swing beam, said first pointer being elongated such that a distal end of said first pointer relative to said swing beam is positioned beyond a line extending from said first end of said rear swing foot parallel to said beam, and a second pointer, said second pointer being diametrically opposed to said first pointer, said second pointer having a length less than a length of said first pointer; and a putting gauge comprising a pair of putter feet, each said putter foot having an associated putter aperture extending therethrough, each of said putter feet having a bottom edge being downwardly spaced from said associated putter aperture, a putter beam, said putter beam being insertable through each of said putter apertures whereby said putter beam is coupled to and extends between said putter feet in upwardly spaced position relative to said bottom edges of said putter feet, said putter beam having a square cross-sectional shape perpendicular to a longitudinal axis of said putter beam, a plurality of putter markings on said putter beam, said putter markings being incrementally spaced along said putter beam between said putter feet, a putter guide, said putter beam being insertable through said putter guide wherein said putter guide is slidable along said putter beam to be positioned adjacent to a selectable one of said putter markings, a bottom face of said putter guide being upwardly spaced from said bottom edges of said putter feet wherein said putter guide is configured for being suspended on said putter beam over a supporting surface upon which said putter feet rest each said associated putter aperture being positioned equidistant between opposite ends of said putter foot wherein said putter beam extends perpendicularly from a middle of each said putter foot, and wherein said putter guide further comprises a middle section, and a pair of needles, said needles extending from diametrically opposed sides of said middle section wherein each of said needles is perpendicular to said putter beam, wherein said needles are symmetrically positioned with respect to said putter beam when said putter beam is inserted through said putter guide, a length between points of said needles being equal to a length of each of said putter feet.

* * * * *